United States Patent [19]

Ross

[11] 4,095,654

[45] Jun. 20, 1978

[54] IMPACT DEVICE WITH MULTIPLE CONNECTING RODS AND GEARING

[76] Inventor: Frederick W. Ross, 755 Klamath Dr., Del Mar, Calif. 92014

[21] Appl. No.: 742,109

[22] Filed: Nov. 15, 1976

[51] Int. Cl.[2] ..... B25D 9/00

[52] U.S. Cl. ..... 173/118; 173/117; 173/122

[58] Field of Search ..... 173/116, 117, 118, 119, 173/120, 121, 122; 308/179

[56] References Cited

U.S. PATENT DOCUMENTS

| | | | |
|---|---|---|---|
| 973,216 | 10/1910 | Rowe | 173/117 |
| 1,191,948 | 7/1916 | Coates | 173/118 |
| 2,659,636 | 11/1953 | Wheelis | 308/179 |

FOREIGN PATENT DOCUMENTS

| | | | |
|---|---|---|---|
| 348,271 | 5/1931 | United Kingdom | 173/118 |

*Primary Examiner*—Robert A. Hafer

[57] ABSTRACT

Rotary-powered exciter-reciprocative means are disclosed by which improvements in efficiency and effectiveness of impact devices, effected by important reductions of wasteful extraneous harmonic vibrations through the use of long double connecting rods, are obtainable in selected embodiments incorporating gearing, by which a smaller lighter weight rotary motor of different rotational frequency from that of the impacting can be utilized.

15 Claims, 8 Drawing Figures

IMPACT DEVICE WITH MULTIPLE CONNECTING RODS AND GEARING

CROSS-REFERENCE TO RELATED INVENTIONS

This invention relates to improvements in exciter-reciprocative drives and in non-rotative guide means of the type set forth in my copending application Ser. No. 534,626 filed Dec. 19, 1974, now U.S. Pat. No. 4,014,392.

BACKGROUND OF THE INVENTION

Prior art impact devices incorporating a high speed rotary motor, gearing, and a single connecting rod, the latter positioned along the line of impacting and attached to the near end of a reciprocating body, necessarily have short connecting rods to avoid impractical lengths of the device. Typically such devices either have the motor offset from the line of impacting or incorporate a single cantilevered crank or split bearings, all of which generate serious problems including those caused by extraneous harmonics as described in my copending application Ser. No. 534,626, in which improved exciter-reciprocative drives are disclosed which either eliminate or reduce to insignificance such wasteful extraneous vibrations.

SUMMARY OF THE INVENTION

The present invention incorporates improved exciter-reciprocative means in which a resilient coupler is reciprocated at a frequency different from that of the rotary drive, by two spaced connecting rods operatively interconnected, in phase, on the same crankshaft, but is distinguished from that disclosed in my copending application Ser. No. 534,626 by incorporation of a crankshaft separate from the rotary shaft of a rotary drive motor, and by the incorporation of improved gearing and crankshaft support means between the separate crankshaft and the motor. By thus incorporating gearing, a smaller, lighter weight but higher speed motor can be utilized while driving the impact rate of the device at a slower frequency.

In a preferred embodiment, the rotary motor is positioned with its rotor shaft normal to the line of reciprocation of the resilient coupler and located between the crankshaft and the resilient coupler, one connecting rod passing along each side of the motor. With this arrangement the connecting rods are longer without increase in the overall length of the device thereby having the advantages of a greater ratio for length of connecting rod to crank radius with corresponding reduction of wasteful extraneous harmonic vibrations as set forth in my copending application.

A second embodiment also incorporates a rotary motor positioned between the crankshaft and the resilient coupler but with the rotor shaft parallel with the line of reciprocation of the resilient coupler in combination with selected non-rotative guide means to guide the resilient coupler along its reciprocative path free of substantial extraneous rotations about such path and hence without the related deficiencies of prior art devices.

A third embodiment has the motor shaft positioned normally with respect to the path of reciprocation of the resilient coupler but with the separate crankshaft located between the rotary motor and the resilient coupler and incorporates gearing with improved crankshaft bearing supports for reduced extraneous harmonic vibrations. No bevel gears are required in this embodiment.

In the aforedescribed embodiments, preferably the means of support and the positioning of the separate crankshaft in relation to the rotary motor and the impact device frame (1) incorporate a substantially symmetric positioning relative to the device frame of (a) the rotary motor and (b) the cranks on the separate crankshaft, (2) incorporate crankshaft bearings and supports therefor in a substantially symmetric arrangement relative to the cranks and the rotary motor, and (3) with the crankshaft bearings supported on symmetrically positioned frame structural elements extending directly to the rotary motor and positioned to apply vibrational and other forces acting between the frame structural elements only in compression rather than in bending or tension during operation of the device. The three aforedescribed factors contribute importantly to the reduction of wasteful losses caused by such extraneous vibrations and to the resulting improved effectiveness of the device by eliminating the generation of many harmonic vibrations and by reducing the amplitude of the remaining extraneous vibrations by utilization of the symmetries described and by better utilization of the mass of the rotary motor as an impedance against such lesser vibrations as are generated.

Additionally all gearing in such embodiments includes improved supports for the shafts on which the gears are mounted, the shafts being supported by specific location of shaft bearings and improved supports therefor to reduce extraneous shaft deflectional vibrations normal to the rotational axis and, for embodiments incorporating bevel (or angle) gears for constraining the shaft motion free of extraneous axial harmonic vibrations.

Crankshaft structures suitable for use with the disclosed embodiments are disclosed, (1) which support the crankshaft to be relatively free from extraneous harmonic vibration and (2) for which shear forces at interfaces between adjacent elements are substantially reduced.

DETAILED DESCRIPTION OF INVENTION

Figure 1:
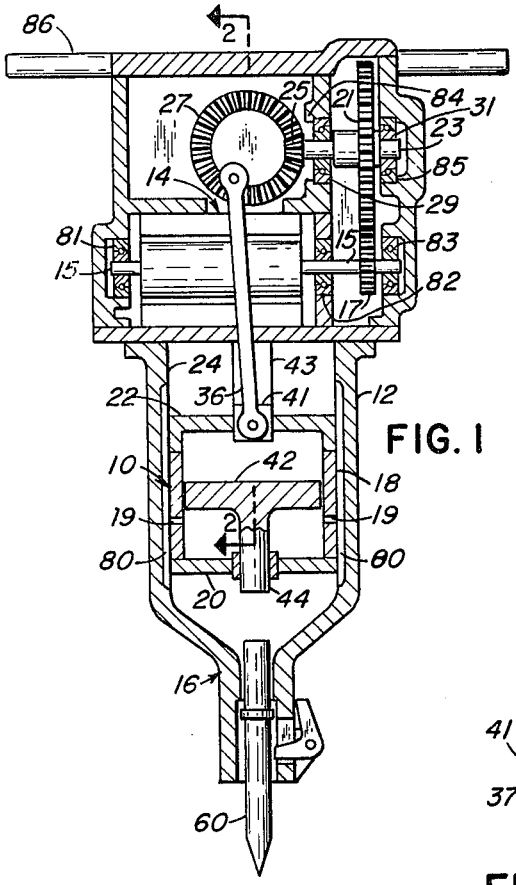
FIG. 1 is a front view, partially cut away of an impact device according to the invention incorporating a rotary motor positioned between a separate crankshaft with the motor rotor shaft positioned normal to the impacting path.

Referring to the drawings, FIGS. 1 through 4 illustrate a preferred embodiment of the invention incorporating a modified embodiment of exciter means for reciprocating a resilient coupler with dual connecting rods as disclosed in my copending application Ser. No. 534,626 filed Dec. 19, 1974.

Cylinder-piston means 10 is mounted for reciprocation in frame 12, which also serves as an enclosing case. Crankshaft 33 is rotatably mounted on frame 12 near the upper or handle end where handle 86 is secured. Cylinder-piston means 10, comprising a barrel 18 together with enclosing end elements 20 and 22 secured thereto, is slidably fitted for reciprocation in frame guide means 24. Output means 16 is located at the lower end, i.e. opposite the handle end, and impact tool 60 is supported for movement axially in output means 16.

Piston 42, slidably and sealably fitted for reciprocation along a path in a direction axially of barrel 18, has shaft 44 secured thereon which slidably and sealably passes through a bushing in end element 20. Piston 42 and shaft 44 impact against impact tool 60 during operation as described hereinafter. Vents 19 through the wall of barrel 18 provide for air flow into or out of the total enclosed space substantially enclosed by barrel 18 and end elements 20 and 22. Vents 19, for stabilizing the excursion range of free piston 42, are preferably, but not necessarily, of the restricted flow type disclosed in my copending application Ser. No. 534,626 filed Dec. 19, 1974.

Power means, in this embodiment rotary motor 14, is secured to frame 12 with the axis of rotor shaft 15 substantially normal to the path of reciprocation of piston 42, and is located between separate crankshaft 33 and cylinder-piston means 10. Two cranks 35 and crankshaft 33 are formed in one piece with both cranks 35 positioned at the same rotational phase angle with one crank on each end of crankshaft 33. Crankshaft 33 is shown rotationally mounted on frame 12 by split journal bearings 39 spaced adjacent each crank 35. One connecting rod 36 interconnects each crank 35 to one of two wrist pins 37 secured to each side of end element 22. Each connecting rod 36 passes alongside an opposite side of rotary motor 14 with sufficient clearance to avoid contact.

The impact device of the invention operates as follows: Rotary motor 14 rotates rotor shaft 15 and pinion gear 17 which meshes with gear wheel 21 to rotate transmission shaft 23 and therewith bevel pinion gear 25. The latter meshes with and hence rotates bevel gear wheel 27 which accordingly rotates crankshaft 33 and cranks 35. Connecting rods 36 operatively interconnect cranks 35 and wrist pins 37 which latter are secured to end element 22. End elements 20 and 22 both secured to barrel 18, then all reciprocate together in frame guide means 24 as a reciprocating body through action of connecting rods 36 upon wrist pins 37 with rotation of crankshaft 33. Reciprocation of the reciprocating body acts through resilient means, the air, in cylinder-piston means 10, which acts as an air spring or resilient coupler to resiliently couple the motion of the reciprocating body to move piston 42, with piston shaft 44 secured thereon, into impacting motion against impact tool 60.

With the relative positioning of rotor motor 14 between crankshaft 33 and the reciprocating body (i.e. and elements 20 and 22 and barrel 18), connecting rods 36 can be made substantially longer without increase in the overall length of the impact device to obtain the improvements obtainable from such longer connecting rods as set forth in my copending application Ser. No. 534,626. By thus obtaining longer connecting rods, wrist pins 37 can be positioned on the near end of reciprocating body and thus importantly reduce structure size and weight. Additionally, the dual connecting rods provide practical means for obtaining the improvements of symmetric positioning of crankshaft 33 with gearing and the supports therefor as described hereinafter. The positioning of the rotary motor with the rotor axis normal to the reciprocating path of the reciprocating body uncouples the tendency for generating motor rotor extraneous rotations as can be caused by connecting rod force variations, and hence importantly reduces the torsional pulsating forces and moments on frame and body guide means structure.

Rotor shaft 15 is shown supported for rotation relative to frame 12 by bearings 81 and 82 in typical position for such motor rotors adjacent each end of the rotor, and by a third bearing 83 supported directly on frame 12 and positioned along rotor shaft 15 adjacent to and on the opposite side of pinion gear wheel 17 from bearing 82, thereby giving additional support to rotor shaft 15 and pinion gear 17 to reduce extraneous radial deflections thereof induced by pulsations in rotational torques and speeds transmitted thereto from connecting rods 36 as set forth in my copending application Ser. No. 534,626. In some applications of this embodiment bearing 82 may not be necessary to accomplish the effects described, bearings 81 and 83 being adequate for such applications.

Additionally, transmission shaft 23 is constrained axially in both directions by bearings 29 and 31 and matching shoulder supports on frame 12 as follows: bearing 29 and matching frame shoulder 84 constrain transmission shaft 23 and pinion gear 25 against thrust and any tendency to move toward crankshaft 33, and bearing 31 and matching frame shoulder 85 support transmission shaft 23 in the opposite direction, both bearings 29 and 31 being selected to support both in thrust as well as radially, the steady and vibrational loads imposed thereon during operation. Likewise, crankshaft 33 is constrained from axial motion by thrust bearing features of split journal bearings 39 and matching frame shoulders as shown in FIG. 2, to reduce radial and axial extraneous vibration of crankshaft 33 as induced by variation in thrust and forces as discussed hereinbefore for transmission shaft 23.

Pinion gear wheel 17 secured on motor rotor shaft 15 for rotation therewith, meshes with matching gear wheel 21 secured on transmission shaft 23. Bevel pinion gear wheel 25, securely mounted on the inboard end of transmission shaft 23 for rotation therewith meshes with matching bevel gear wheel 27 which is secured near mid-length on a portion of crankshaft 33 having an enlarged diameter, the enlargement being necessary so bevel gear 27 can pass over one of the cranks 35 at one end of the crankshaft 33 and also fit securely to the crankshaft mid-portion.

Figure 2:
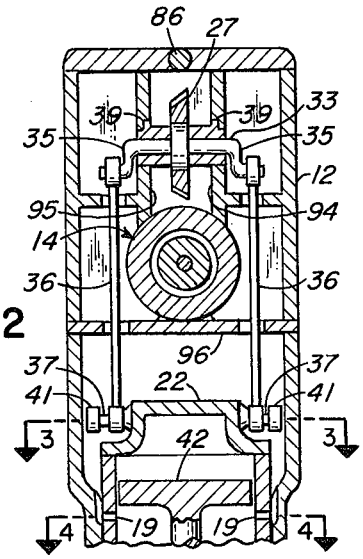
FIG. 2 is a sectional view of the device taken along line 2 — 2 of FIG. 1.
Figure 3:
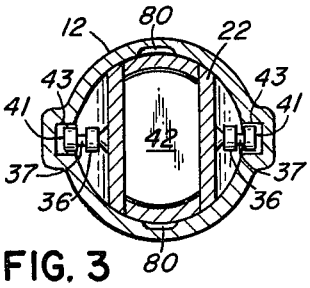
FIG. 3 is a sectional view taken on line 3 — 3 of FIG. 2.
Figure 4:
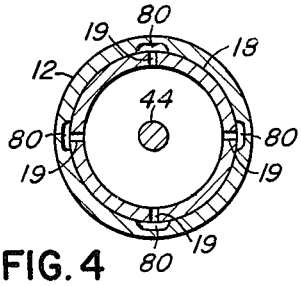
FIG. 4 is a sectional view taken on line 4 — 4 of FIG. 2.

As viewed in FIG. 2, crankshaft 33 is secured on frame 12 in a position so that cranks 35 and bearings 39 are all positioned substantially symmetrically about the line of reciprocation of cylinder-piston means 10, by frame structural elements 94 and 95, the latter also being symmetrically positioned relative to the line of reciprocation. Rotary motor 14, also positioned substantially symmetrically about the line of reciprocation, is held securely in position by frame structural element 96 as well as frame structural elements 94 and 95. With such positioning of rotary motor 14 and crankshaft 33, frame elements 94, 95, and 96 support crankshaft 33 firmly and symmetrically against rotary motor 14 and both firmly in frame 12. By thus firmly, directly and symmetrically holding crankshaft 33 against rotary motor 14 as well as frame 12, less extraneous harmonic vibrations are generated and those that are generated are importantly reduced.

This embodiment of a geared exciter-reciprocative drive for reciprocating the reciprocating coupler cylinder-piston means 10 has all the advantages disclosed for ungeared exciter-reciprocative drives disclosed in my copending application Ser. No. 534,626 except for the frequencies generated by the gear teeth. But the latter are reduced in amplitude with the more rigid supports described hereinbefore.

Cross heads 41, fitted for sliding in offset slots 43, offset from partial cylinder portion 24, may preferably be incorporated to provide non-rotational guide support to maintain reciprocation of the dual connecting rod arrangement substantially free of extraneous rotational oscillations about the path of reciprocation during operation. The frame and body guide means disclosed herein are an alternate embodiment of the frame and body guide means disclosed in my copending application Ser. No. 534,626, filed Dec. 19, 1974.

Figure 5:
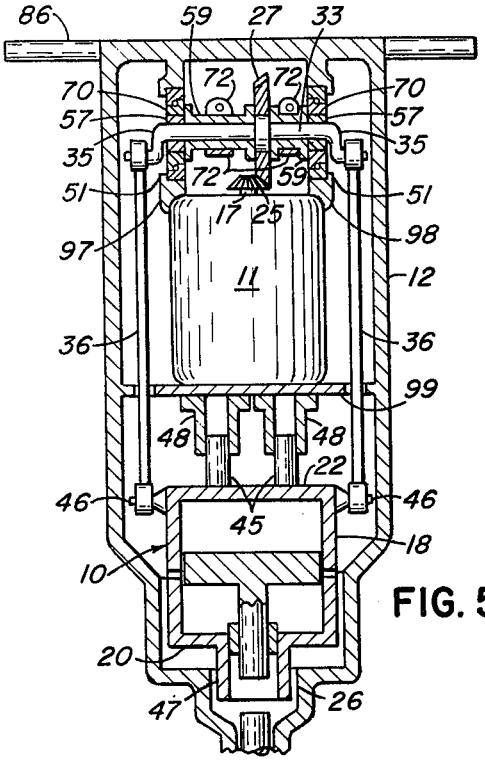
FIG. 5 is a partial front view, partially cut away, of a second embodiment of the impact device with the motor rotor axis positioned parallel with the impacting path and with a separate crankshaft, non-split bearings and split bearing spacers.

FIG. 5 illustrates an alternative embodiment with rotary motor 11 between cylinder-piston means 10 and separate crankshaft 33 wherein motor 11 is positioned with the axis of its rotor shaft 17 substantially parallel or aligned with the path of reciprocation rather than normal thereto as in FIG. 1.

Non-rotative guide means comprise body (i.e. cylinder-piston) guide means in the form of two guide cylinders 45 secured to and extending out from end element 22 in a position parallel with but with at least one guide cylinder offset from the axis of barrel 18, and a third guide cylinder 47 secured to and extending down from end element 20 and substantially coaxial with barrel 18. Each guide cylinder is fitted for sliding relation coaxially within a matching, cylindrical barrel 48 or 26 secured to frame 12. Such guide cylinders 45 and 48, and the matching cylindrical barrels 26 and 48 form an alternate embodiment of body and frame guide means respectively disclosed in my copending application Ser. No. 534,626.

With such crankshaft and motor location as illustrated in FIG. 5 as in FIG. 1, the improvement of longer connecting rods is obtained with wrist pins 46 positioned on the end of cylinder-piston means 10 nearer crankshaft 33. Additionally, for the embodiments illustrated in both FIGS. 1 and 2, and 5 with the wrist pins positioned beyond the longitudinal center of barrel 18 toward the far end of cylinder-piston means 10, further improvement in reduced extraneous connecting rod vibrations can be obtained as set forth in my copending application Ser. No. 534,626.

FIG. 5 also illustrates an alternate embodiment of crankshaft 33 with integral cranks 35 formed on each end thereof and with bevel gear wheel 27 keyed and pressed on an enlarged diameter of crankshaft 33 as shown in FIG. 2, but with the improvement of non-split bearings 70, preferably of the anti-friction type, each incorporated with a pair of C-shaped half barrel spacers 57 formed as substantially half a hollow right cylindrical barrel split on a diameter. Each non-split bearing 70 has an inner diameter large enough so bearing 70 can be slipped past one of the cranks 35 on crankshaft 33 for installation thereon; and each pair of half-barrels 57 has an inner diameter to fit tightly over crankshaft 33 and an outer diameter sufficient for nonsplit bearing 70 to be pressed thereover to tightly support the inner race of the anti-friction bearing 70 on crankshaft 33.

FIG. 5 also shows non-split bearings 70, one adjacent to each crank 35 and supported symmetrically by frame structural elements 97 and 98, and rotary motor 11 by frame structural element 99 in addition. Thus frame elements support cranks 33 directly and securely to frame 12.

Preferably the crankshaft and motor and related components of the embodiment as illustrated in FIG. 5 are arranged to be substantially symmetric as illustrated and described for corresponding components of the embodiment shown in FIGS. 1 and 2.

Also, preferably, crankshaft 33 as illustrated in FIG. 5 is supported to be constrained against axial movement by structural shoulders 51 as described for crankshaft 33 in FIG. 2, and likewise rotor shaft 17 may be so constrained, such axial constraints to reduce axial deflections and vibrations of the respective shafts induced by varying forces and speeds caused by reaction forces from connecting rods 36, especially in bevel gears during operation as described hereinbefore. Shims or other means readily known in the art can be used for practical fitting of the respective parts to assure close fitting and remove undesirable slack in axial motion.

Figure 6:
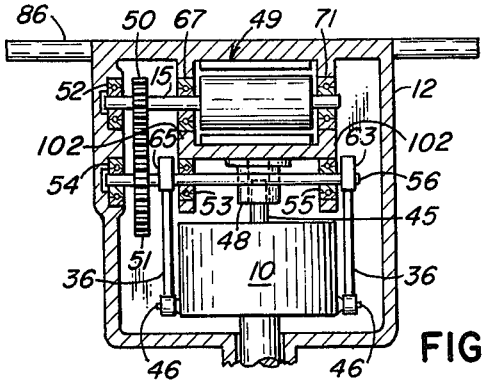
FIG. 6 is a partial view, partially cut away of a third embodiment of the impact device with a separate crankshaft positioned between the motor and the resilient coupler and with the motor rotor axis normal to the impacting path.

FIG. 6 illustrates an alternate embodiment of the invention with crankshaft 56 located between cylinder-piston means 10 and rotary motor 49, the latter securely mounted on frame 12 including frame element 102 in a position substantially symmetrical with respect to the path of reciprocation of cylinder-piston means 10 and with the axis of rotor shaft 15 substantially normal to the path of reciprocation. Crankshaft 56 which can be of the same type as crankshaft 33 shown in FIG. 1 or 5 is shown as a one-piece straight cylindrical shaft. Crankshaft 56, supported symmetrically on frame element 102 by bearing 53 positioned near one end thereof and bearing 55 positioned near the opposite end, has one crank near one end, shown as eccentric 63, and a second crank, eccentric 65, positioned near the opposite end, both eccentrics encircling the crankshaft and pressed and keyed to rotate therewith as disclosed in my copending application Ser. No. 534,626. Pinion gear wheel 50 pressed and keyed on rotor shaft 15 for rotation therewith, meshes with gear wheel 51 which is secured as by keying near one end of crankshaft 56. Crankshaft 56 is thereby rotated upon rotation of motor rotary shaft 15. Motor rotor shaft 15 is rotationally supported directly on frame 12 by bearing 52 adjacent pinion gear 50 and by bearing 71 on the opposite end of shaft 15. Preferably bearing 53 securely supported on frame 12 and positioned along crankshaft 56 on the side of gear wheel 51 opposite from eccentric 65 and bearing 67 positioned along rotor shaft 15 on the opposite side of pinion gear 50 from bearing 52 may, but not necessarily, be added for additional restraint of extraneous radial vibrations as discussed hereinbefore.

In FIG. 6 wrist pins 46 are preferably positioned near the end of cylinder-piston means 10 more remote from crankshaft 15, thereby providing for longer connecting rod lengths and thus increasing the ratio of connecting rod length to crank radius without increase in length of the impact device, thereby reducing substantially wasteful extraneous vibrations as discussed hereinbefore, for an embodiment with the crankshaft positioned on the same side of rotary motor 49 as cylinder-piston 10. Additionally such longitudinal positioning of the axis of wrist pins 46 supports the connecting rods on cylinder-piston 10 beyond the effective longitudinal mid-point and acts to stabilize the motion of the reciprocating body and the piston during reciprocation.

For the embodiment illustrated in FIG. 6, the crankshaft bearings are positioned substantially symmetrically adjacent the respective cranks and are supported directly and substantially symmetrically on the rotary motor through a frame element, such as frame element 102 as also illustrated for similar frame elements in FIGS. 1, 2, and 5. Additionally, FIGS. 1, 2, 5 and 6 show that the respective frame structural elements by which the respective crankshaft bearings are secured to the respective rotary motors, transmit all forces therebetween through only a single solid unjointed structural frame element between motor and each bearing and that such single structural element is free of joints and is joined to motor and bearings, respectively, as shown, so that all forces and loads pass only through butt joints substantially free of shearing loads therebetween.

The output of the exciter-reciprocative means of the present invention reciprocates a reciprocating output element, e.g. wrist pin 37 of FIGS. 1 and 2 or wrist pin 46 of FIGS. 5 and 6 which thereby reciprocates a reciprocating body including barrel 18 and related end elements illustrated in FIG. 1, e.g. as resilient coupler means 10, here shown as cylinder-piston 10 with pistion 42 and piston shaft 44 secured thereon acting as ram means. It will be evident to those skilled in the art that the exciter-reciprocation means of the invention will effect similar improvements with reciprocating bodies other than that disclosed herein including bodies without resilient coupling.

Furthermore, preferably the ram means, e.g. piston 42 and piston shaft 44 are symmetric as shown in FIGS. 1 and 2 at least about a plane containing the path of reciprocation of the center of mass of the ram. Similarly, although it is preferably to have the respective rotary motors shown in FIGS. 1, 2, 5, and 6 positioned on such path of reciprocation and to have the axes of the respective crankshafts either aligned with or intersecting therewith, in actual installations such ideal arrangements may be impractical. For example, the embodiment shown in FIG. 6 may be modified with the motor positioned between crankshaft 56 and cylinder-piston means 10 by offsetting the motor (with rotor axis still parallel to crankshaft 56) sufficiently to permit the two connecting rods to pass by the motor, one connecting rod near each end thereof, but off-side sufficiently to prevent interference with crankshaft 56.

Alternatively, with the motor substantially between crankshaft 56 and cylinder-piston 10, one or both connecting rods can be formed with an expanded lateral portion thereof hollowed out sufficiently to allow crankshaft 56 to extend therethrough without interference during operation.

Figure 7:
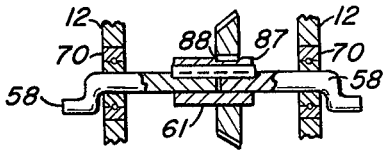
FIG. 7 is a sectional view of a crankshaft divided in the mid-region with a matching sleeve fitted between the divided parts.
Figure 8:
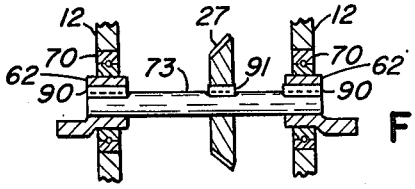
FIG. 8 is a sectional view of a crankshaft with separate end elements.

FIGS. 7 and 8 illustrate two alternate embodiments of crankshaft 33 shown in FIGS. 2 and 5. In FIG. 7 the crankshaft, corresponding to crankshaft 33 of FIG. 5, is cut substantially at mid-length into two half-shaft elements 58, and upon assembly, after pressing non-split bearings 70 in position on each half-shaft element 58, the respective half-shaft elements are pressed and keyed into matching sleeve 61. Gear wheel 27, e.g. is pressed and keyed to sleeve 61 for rotation therewtih upon rotation of the half-shaft elements 58.

FIG. 8 illustrates another alternate embodiment with crankshaft 73 constructed without integral cranks. The cranks are each formed as separate crank-sleeve elements 62 pressed and keyed to each end of crankshaft 73. Non-split bearings 70 are pressed over the crank-sleeve element 62 as shown. Bevel gear 27 is keyed and pressed on shaft 73 in the mid-length region on a portion of crankshaft which may or may not be enlarged diameter as necessary to fit and mesh with the mating gear as shown in the other figures herein.

It is evident that the crankshaft bearing and bearing support embodiments shown in FIGS. 7 and 8 as well as those shown in FIGS. 2 and 5 can be incorporated in any impact device of the type incorporating at least two connecting rods as disclosed herein.

Furthermore, on all impact devices of the type disclosed herein which incorporate two connecting rods spaced along the same crankshaft, both cranks on all crankshafts are formed to have equal radii and the same rotational phase within practical manufacturing tolerances.

The crankshaft mounting arrangement with two connecting rods shown in FIGS. 1, 2, and 5 and the divided crankshafts shown in FIGS. 7 and 8 all retain the essential improvements set forth in my copending application Ser. No. 534,626 filed Dec. 19, 1974 in which thd main reactive pulsating forces from the connecting rods as induced therein by the reciprocation of the piston and shaft through the reciprocation of cylinder-piston means 10 are retained for devices for which the size of eccentrics would be impractically large with the straight shaft eccentric cranks as disclosed in Ser. No. 534,626. Further, with all embodiments disclosed, the shaft bending moments are low because the axial spacing of each crank from adjacent supporting bearing is small, all forces passing through the crankshaft from the connecting rods are substantially symmetrically arranged and all forces pass through the respective joints from crank pin to respective gear mounted thereon only substantially normally to the respective surface interfaces as in the embodiments disclosed in my copending applications referred to hereinbefore. Such mounting arrangement as disclosed herein are substantially free of shear rubbing between surfaces at such interfaces, an important improvement for such devices which experience high oscillating forces as in the impact devices disclosed herein.

The incorporation of gearing between rotary motor and crankshaft offers the improvement of utilizing lighter weight, higher speed, and lower power motors with fewer impacts per second. Such a feature is important because with lesser impacts per second, more energy can be spent in each such impact with limited power. This is particularly advantageous in some types of impact devices, especially in smaller, lighter weight units.

With the embodiments disclosed herein, highly undesirable extraneous vibrations as occur in prior art devices of the type considered herein are eliminated or reduced to relative insignificance except those specifically caused by the gearing. The latter are reduced significantly because the selected arrangements disclosed support the relative spacings of gears more rigidly than do prior art arrangements in keeping with the principles set forth in my copending application Ser. No. 534,626, filed Dec. 19, 1974.

Having thus described my invention, I claim:

1. An impact device having a frame with exciter-reciprocative means mounted thereon for driving a reciprocating element in reciprocation along a substantially straight selected path relative to the frame, output tool means, ram means free for reciprocation substantially along the selected straight path for impacting against the output tool means, and coupler means operatively interconnecting the reciprocating element to the ram means for actuation thereof upon reciprocation of the reciprocating element, said exciter-reciprocative means comprising:

a crankshaft rotatably mounted on crankshaft bearings secured on said frame, a rotary motor mounted on said frame and having a rotor shaft with rotor axis, gearing means operatively interconnecting said rotor shaft with said crankshaft for rotation thereof at a rotational speed different from that of said rotor shaft, at rotary two connecting rods operatively connected to said crankshaft in a spaced relation for actuation thereby in substantially the same rotational phase at substantially the same crank radius positioning operatively connected to reciprocate and rotary element along said selected path upon rotation of said crankshaft, and said rotaty motor mounted on said frame substantially between said crankshaft and said reciprocating element and substantially between at least two of said at least two connecting rods, said positioned of said coupler means, said rotor motor, said crankshaft and said at least two connecting rods providing means for substantially longer connecting rods to substantially reduce extraneous vibrations and extraneous forces occurring therefrom during operation.

2. An impact device as claimed in claim 1 further comprising said crankshaft bearings secured to said rotary motor by at least one frame element extending substantially as a column directly between said crankshaft bearings and said rotary motor and connected thereto through joints positioned to support reaction forces from said at least two connecting rods transmitted therethrough substantially normal to the interface of said joints and substantially free of shear forces between joining elements at said joints.

3. An impact device as claimed in claim 2 wherein said crankshaft bearings include at least one such bearing adjacent each said at least two connecting rods for reduced crankshaft bending, and said crankshaft bearings, said at least one frame element, said at least two connecting rods, said rotary motor and said reciprocating element are positioned substantially symmetrically with respect to said selected path.

4. An impact device as claimed in claim 1 wherein said rotary motor is mounted with said rotor axis substantially at right angles to said selected path.

5. An impact device as claimed in claim 4 further comprising:

a pinion gear wheel secured on one end of said rotor shaft, a main bevel gear wheel secured on said crankshaft at the mid-portion thereon, and a transmission shaft rotatably mounted on said frame and said rotary motor on the side of said rotary motor opposite from that of said reciprocating element, and positioned with axis of said transmission shaft substantially parallel with said rotor shaft.

6. An impact device as claimed in claim 5 wherein said transmission shaft having a main gear wheel secured near one end thereof for meshing with said pinion gear wheel and a bevel pinion gear secured on the other end thereof for meshing with said main bevel gear.

7. An impact device as claimed in claim 1 wherein said rotary motor is mounted with said rotor axis substantially parallel with said selected straight path.

8. An impact device as claimed in claim 7 further comprising:

a body mounted on said frame for reciprocation along said selected path, said reciprocating element secured to said body for reciprocation thereof, non-rotative guide means operatively interposed between said frame and said body and guiding said body in substantially linear reciprocation along said selected path substantially free of extraneous rotation from torques imposed on the body by angular thrust of the connecting rods.

9. An impact device as claimed in claim 8 wherein said non-rotative guide means comprises substantially straight line track means rotationally asymmetric and substantially parallel with respect to the selected path of body reciprocation and at least one track engaging element mounted for guided engagement with the track means during body reciprocation, the track means and the track engaging element being mounted one to the frame, and one to the body.

10. An impact device as claimed in claim 1 further comprising:

a body mounted on said frame for reciprocation substantially along said straight path, said ram means mounted for reciprocation substantially parallel with said selected path, said reciprocating element comprising two wrist pins mounted in spaced relation on said body for reciprocation thereof, the axis of each wrist pin being substantially aligned to a common axis, said ram means having a principal axis substantially aligned with the direction of the impacting motion of said ram means, said wrist pins being laterally spaced, one wrist pin being on one side of the principal axis, and another wrist pin being on the opposite side, at least one connecting rod pivoted on each wrist pin, and the substantially common axis of said wrist pins located at a longitudinal position on said body between the longitudinal mid-point and the end of said body more distant from said crankshaft, said positioning of said wrist pins acting to stabilize the motion of the body and the ram means during reciprocation thereof.

11. An impact device comprising:

a frame, a crankshaft rotatably mounted on said frame, exciter means operatively mounted to rotate said crankshaft, a body mounted for reciprocation on said frame, at least two connecting rods connected to said crankshaft in a spaced relation for actuation thereby in substantially the same rotational phase and operatively connected to reciprocate said body upon rotation of said crankshaft, ram means mounted on said body and free for reciprocation relative thereto substantially parallel to reciprocation of the body, resilient means interposed between said body and said ram means for converting reciprocating motion of said body to impacting motion of said ram means, impact tool means operatively mounted on said frame for impact by said ram means during each reciprocation thereof, non-rotative guide means acting between said frame and said body for restricting the reciprocative motion of said body to substantially linear reciprocation substantially free of extraneous rotations, at least two wrist pins mounted in spaced relation on said body, the axis of each wrist pin being substantially aligned to a common axis, said ram means having a principal axis substantially aligned with the direction of the impacting motion of said ram means, said wrist pins being laterally spaced, one wrist pin being on one side of the principal axis, and another wrist pin being on the opposite side, at least one connecting rod pivoted on each wrist pin, and the substantially common axis of said wrist pins is located at a longitudinal position on said body between the longitudinal mid-point and the end of said body more distant from said crankshaft, said positioning of said wrist pins acting to stabilize the motion of the body and the ram means during reciprocation thereof, wherein the improvement comprises:

said exciter means comprises a rotary motor having a rotor shaft and gearing means operatively interconnecting said rotor shaft with said crankshaft for rotation thereof at a rotational speed different from that of said rotor shaft thereby providing lower impact rate with higher energy loss per impact with lower powered rotary motor.

12. A reciprocating device comprising:

a frame, a crankshaft formed as one piece rotatably mounted on at least two crankshaft bearings secured on said frame, exciter means for rotating said crankshaft, a reciprocating element mounted for reciprocation along a substantially straight selected path relative to said frame, an end crank formed integrally on each end of said crankshaft, each said end crank having substantially the same crank radius and positioned in substantially the same rotational phase, at least one connecting rod operatively interconnecting each said crank with said reciprocating element for reciprocation thereof upon rotation of said crankshaft, each said at least two crankshaft bearings is of the non-split type having an inner and an outer race and a bore diameter of said inner race sufficiently large to permit slipping said crankshaft bearings past one said end crank, and a pair of C-shaped half-barrel radial spacers formed to fit tightly over said crankshaft, and one said pair of radial spacers fitted for pressing each said crankshaft bearing tightly thereover, thereby securing the inner race of said non-split bearing firmly to said crankshaft.

13. A reciprocating device comprising:

a frame, a crankshaft rotatably mounted on at least two crankshaft bearings secured on said frame, exciter means for rotating said crankshaft, a reciprocating element mounted for reciprocation along a substantially straight selected path relative to said frame, said crankshaft having a crank on each end thereof, each crank positioned at substantially the same rotational phase and having substantially the same crank radius, one of said at least two crankshaft bearings positioned adjacent each said crank for reducing crankshaft bending, a connecting rod operatively interconnecting each said crank with said reciprocating element for reciprocation thereof upon rotation of said crankshaft, said crankshaft comprising two end elements each having a crank formed thereon and a medial element, said end elements being pressed and keyed to said medial element, and each said crankshaft bearing is of the non-split type, at least one of which is pressed on each end element.

14. A reciprocation device as claimed in claim 13 wherein each said end element has a length substantially half the length of said crankshaft and said medial element comprises a sleeve, said end elements pressed and keyed into said sleeve.

15. A reciprocating device as claimed in claim 13 wherein said medial element has a length substantially equal to the axial length of said crankshaft and said end elements are pressed and keyed over said medial element.

* * * * *